US010273771B2

(12) United States Patent
Bonderover et al.

(10) Patent No.: US 10,273,771 B2
(45) Date of Patent: Apr. 30, 2019

(54) DOWNHOLE TRACTOR WITH REDUNDANT MOTOR DRIVES WITH INDEPENDENT CIRCUIT BREAKERS

(71) Applicant: C6 TECHNOLOGIES AS, Stavanger (NO)

(72) Inventors: Eitan Bonderover, Hafrsfjord (NO); Sam Schroit, Stavanger (NO)

(73) Assignee: C6 TECHNOLOGIES AS, Stavanger (NO)

( * ) Notice: Subject to any disclaimer, the term of this patent is extended or adjusted under 35 U.S.C. 154(b) by 399 days.

(21) Appl. No.: 15/112,066

(22) PCT Filed: Jan. 28, 2014

(86) PCT No.: PCT/NO2014/000006
§ 371 (c)(1),
(2) Date: Jul. 15, 2016

(87) PCT Pub. No.: WO2015/115904
PCT Pub. Date: Aug. 6, 2015

(65) Prior Publication Data

US 2016/0333653 A1 Nov. 17, 2016

(51) Int. Cl.
*E21B 43/24* (2006.01)
*E21B 23/14* (2006.01)
(Continued)

(52) U.S. Cl.
CPC ..... *E21B 23/14* (2013.01); *E21B 4/04* (2013.01); *E21B 4/18* (2013.01); *E21B 2023/008* (2013.01)

(58) Field of Classification Search
CPC ... B25J 11/00; B25J 9/026; A61B 5/01; E21B 43/24; E21B 36/04; E21B 47/12
See application file for complete search history.

(56) References Cited

U.S. PATENT DOCUMENTS 6,273,189 B1 * 8/2001 Gissler ..... E21B 4/04 166/241.1
2005/0051327 A1 * 3/2005 Vinegar ..... E21B 36/02 166/256

(Continued)

FOREIGN PATENT DOCUMENTS

WO 2000/046481 A2 8/2000
WO 2008/100362 A2 8/2008

OTHER PUBLICATIONS

International Search Report for related application No. PCT/NO2014/000006, dated Sep. 24, 2014, in 4 pages.

*Primary Examiner* — Bickey Dhakal
*Assistant Examiner* — Charles S Laughlin
(74) *Attorney, Agent, or Firm* — Procopio, Cory, Hargreaves & Savitch LLP

(57) ABSTRACT

The invention is a downhole petroleum well tractor having a main body (0) connectable to an electrical conductor logging cable (5) from a surface high voltage DC power supply (50), characterized by said main body (0) comprising a common HV DC power line (4) provided with high-voltage DC power supplied from said electrical cable (5); two or more HV DC branch power lines (40) from said common HV DC power line (4), each said HV DC branch power line (40) feeding power to a HV motor drive electronic unit (21) for a drive motor (2); each said drive motors (2) driving one or more drive devices (6) for running on and along a wall in a well for moving said tractor; separate HV DC circuit breaker units (8) on each said HV DC branch power line (40), each said HVDC circuit breaker (8) unit comprising control means (82, 86, 88) arranged for monitoring a current (I) on said HV DC branch power line (40) and controlling a HV DC power switch (84) on said HV DC branch power line (40) to break said current (I) if said current (I) exceeds said set current level (Imax). Each said (Continued)

HV circuit breaker unit (8) is arranged to disconnect its associated motor (2) in case of said associated motor (2) fails, by detecting an increased current above a set current level, in order to prevent shorting said HV power line (4), thus maintaining operation of the other motors (2) of the tractor.

35 Claims, 3 Drawing Sheets

(51) Int. Cl.

| | |
|---|---|
| ***E21B 4/18*** | (2006.01) |
| ***E21B 4/04*** | (2006.01) |
| *E21B 47/12* | (2012.01) |
| *E21B 23/00* | (2006.01) |

(56) References Cited

U.S. PATENT DOCUMENTS

| | | | | |
|---|---|---|---|---|
| 2005/0145415 | A1 | 7/2005 | Doering et al. | |
| 2008/0308318 | A1 | 12/2008 | Moore | |
| 2009/0308656 | A1* | 12/2009 | Chitwood | E21B 4/04 175/40 |
| 2011/0036560 | A1* | 2/2011 | Vail, III | E21B 28/00 166/87.1 |

* cited by examiner

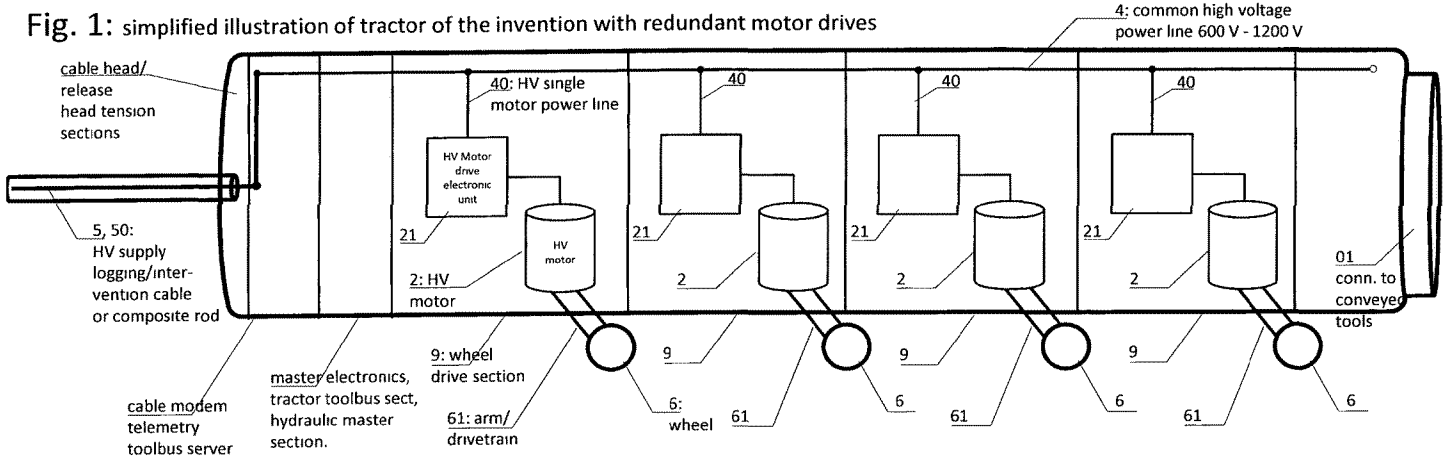
Fig. 1: simplified illustration of tractor of the invention with redundant motor drives
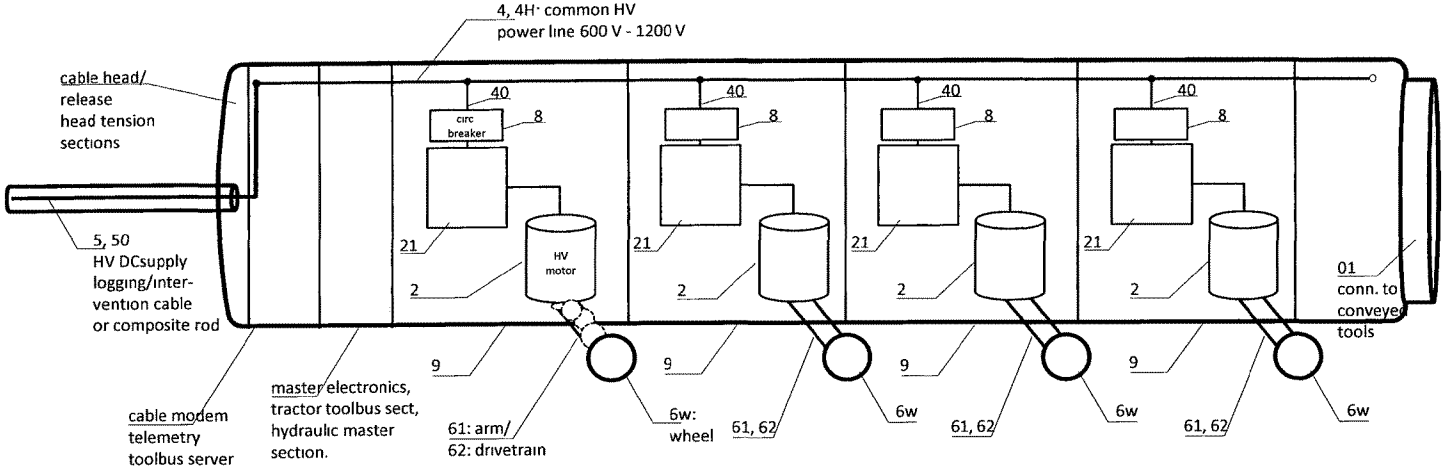
Fig. 2: simplified illustration of tractor according to the invention with redundant motor drives and high voltage circuit breakers. Optional arms with drive wheels, which may be drive belts, etc.

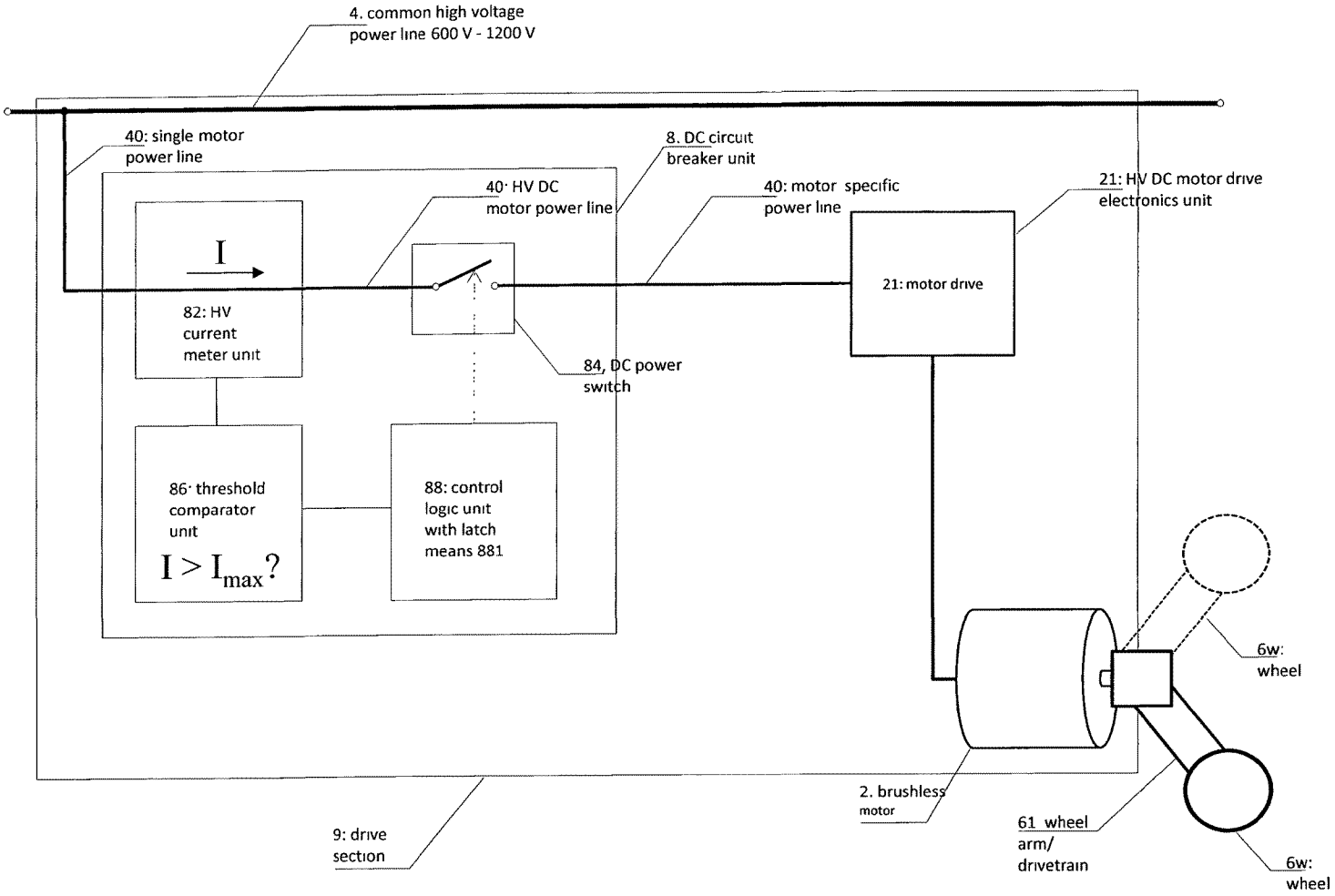
Fig. 3: HV circuit breaker main components for one motor in one drive section, the motor driving one or two wheels.

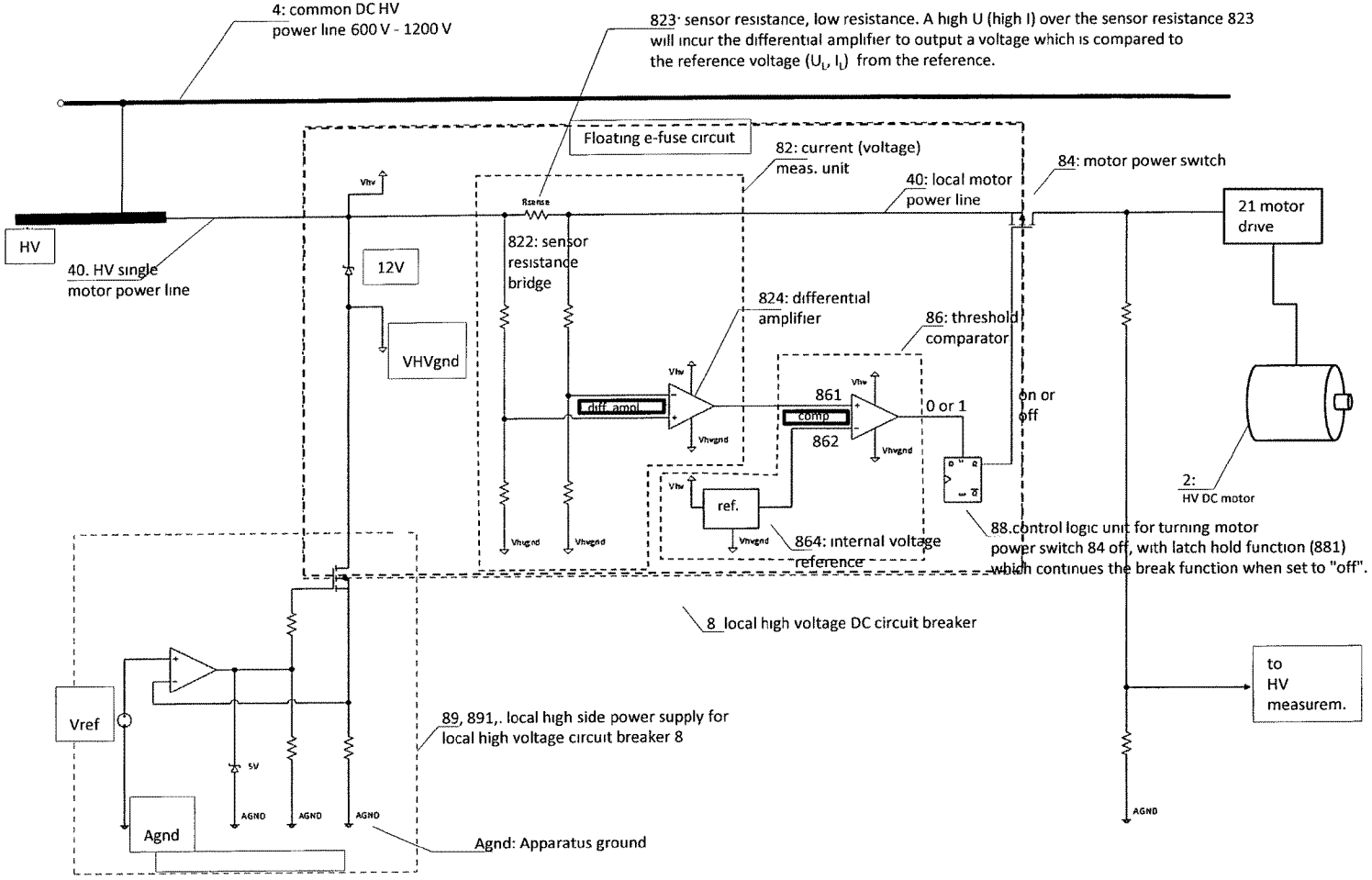
Fig. 4: embodiment of High Voltage local motor circuit breaker

DOWNHOLE TRACTOR WITH REDUNDANT MOTOR DRIVES WITH INDEPENDENT CIRCUIT BREAKERS

INTRODUCTION

The present invention relates to a downhole petroleum well tractor for conveying logging or intervention tools in the well. More specifically, the invention relates to an electrically driven downhole petroleum well tractor connected to a surface DC high voltage supply via an electrically conducting logging cable.

BRIEF SUMMARY OF THE INVENTION

The invention is a downhole petroleum well tractor having a main body (0) connectable to an electrically conducting logging cable (5) from a surface high voltage DC power supply (50), wherein said main body (0) comprises a common power line (4) provided with energy supplied from said electrical cable (5), two or more drive motors (2) supplied with power from said common power line (4) each via a branch power line (40), each said drive motors (2) driving one or more drive devices (6) for running on and along a wall in a well for moving said tractor, and separate circuit breaker units (8) for each said drive motors (2) on said branch power line (40), said circuit breaker unit (8) arranged for monitoring a current (I) to said motor (2) and breaking said current (I) in case said current (I) exceeds a set current level (Imax).

The invention is also a method for preventing downhole petroleum well tractor failure, said tractor having a main body (0) connected to an electrically conducting logging cable (5) from a surface high voltage DC power supply (50), said main body (0) comprising a common power line (4) provided with energy supplied from said electrical cable (5), and two or more drive motors (2) supplied with power from said common power line (4) each via a branch power line (40), each said drive motors (2) driving one or more drive devices (6) running on and along a wall in a well and moving said tractor; wherein said method comprises continuously monitoring a current (I) on each said branch power line (40), and in case said current (I) on any one of said branch power line (40) exceeds a set current level (Imax), breaking said current (I) separately on said branch power line (40) by means of a circuit breaker unit (8) on said branch power line (40).

Further embodiments of the invention are defined in attached dependent claims.

An advantage of the invention is that by disconnecting the failed motor and motor drive it allows the remaining motors to function as normal and the whole tool can continue at reduced performance.

SHORT FIGURE CAPTIONS

The invention is illustrated in the attached drawing Figures.

FIG. 1 is a simplified illustration of the tractor according to the invention with two or more wheel drive sections. Each wheel drive section is provided with drive wheels driven by brushless DC motors. Each brushless DC motor is powered through a DC electronic motor drive connected to a common high voltage power line in the tractor. A tractor according to the invention may have e.g. two, three or more drive sections, each drive section having a brushless DC motor, so the number of motors in the tractor is two or more, preferably four, six or more motors. The common high voltage power line of the tractor is connected to a DC line of the logging cable extending from the surface high voltage DC power supply.

FIG. 2 is a more detailed simplified illustration of the tractor according to the invention wherein a high voltage circuit breaker is inserted on each branch power line (40) from the common high voltage power line (4).

FIG. 3 illustrates main components of the high voltage circuit breaker (8) for one motor drive in a drive section. The motor drive is for a motor with a drivetrain for driving one or more wheels or belts, preferably on actuated arms. It comprises a high voltage current meter unit (82), a threshold comparator unit (86), a control logic unit (88) and a DC power switch (84). The purpose of the high voltage circuit breaker (8) is to monitor the current and to break the current on power switch (84) on branch power line (40) when said threshold comparator (86) detects if said current (I) exceeds the set current level (Imax). If the motor drive should fail and short so the current on the single motor power line (40) increases above the allowable set current level (Imax) the increased current will be detected and the power switch (84) will cut before further damage is incurred. Thus the remaining drive sections' (9) power lines (40) will continue to provide power and the tractor may continue to be operated in the well.

FIG. 4 is a simplified circuit diagram of a local high voltage motor drive circuit breaker according to the invention. It comprises a local DC branch power line (40) for receiving high voltage, here 600 V with excursions up to 1200 V, from the common DC high voltage power line (4). The illustrated local high voltage DC circuit breaker is a floating electronic fuse circuit (8) provided with low voltage power from a local high side power supply (89) so as for supplying energy via the high voltage branch power line (40). Further details of the local high voltage DC circuit breaker (8) is given below.

EMBODIMENTS OF THE INVENTION

FIG. 1 is a simplified illustration of a tractor according to the invention with two or more wheel drive sections. Each drive section comprises two or more wheels for driving the tractor along a wall in the well, the wall being the borehole wall or an inner wall of a tubing or casing. Each wheel drive section is provided with drive wheels driven by brushless DC motors. Each brushless DC motor is powered through a DC electronic motor drive connected to a common high voltage power line in the tractor. The common high voltage power line of the tractor is connected to a DC line of the logging cable extending from the surface high voltage DC power supply. The preferred operating voltage on the common high voltage power line and the electronic motor drives is 600 V. Due to resistivity in the logging cable, which may be of a length at least the depth of the well, the surface power supply may have to operate up to 1200 V in order to try and maintain the desired operating voltage of 600 V and current up to 6 A or more on the common high voltage power line. If the current on the common high voltage power line suddenly drops, the voltage drop over the cable between the surface power supply and the tractor becomes lower. Thus the common high voltage power line may experience peaks or excursions up to 1200 V if the surface high voltage DC power supply does not adjust the voltage down or does not do so fast enough.

If one of the motors fails there is a risk that it may short the common high voltage power line unless the local current to the motor is broken. If the common high voltage power line is shorted then the tractor would fail and have to be pulled out of the well. Pulling the tractor would cause interruption of the logging procedure and cost additional time for retrieving the tractor and the conveyed logging string from the well, replacement or repair of the tractor and additionally the time for assembling and resuming running the tractor in the well.

The invention illustrated in FIGS. 1 and 2 is downhole petroleum well tractor having a main tractor body, a main body (0) connectable to an electrically conducting logging cable (5) from a surface high voltage DC power supply (50). The logging cable (5) is here used as a broad term which may comprise a wireline or intervention cable or a composite rod-like cable with a conductor directly or indirectly connected to the main body's (0) common power line (4) provided with energy supplied from said electrical cable (5). The common power line (4) extends through all the wheel drive sections (9) of the tractor. In general the tractor has a connector (01) in its opposite end for mechanically and electrically connecting to conveyed tools. The tractor has two or more electrical drive motors (2) supplied with electrical power from said common power line (4) each via a branch power line (40). Each said drive motors (2) drives via a drivetrain (62) one or more mechanical drive devices (6) such as drive wheels (6*w*) or drive belts (6*b*) for running on and along a wall in a well, such as a borehole wall, a pipe wall, through a valve, etc., for moving said tractor along in the well. The tractor is provided with separate circuit breaker units (8) for each said drive motor (2) on each said branch power line (40), please see FIGS. 2 and 3. The circuit breaker unit (8) is arranged for monitoring a current (I) to said motor (2) and breaking said current (I) in case said current (I) exceeds a set current level (Imax).

Thus, each said circuit breaker unit (8) is made for disconnecting its associated motor (2) in case said associated motor (2) fails, by detecting an increased current above the set current level, in order to prevent shorting said local HV branch power line (40) thus shorting said HV power line (4). Preventing such a short circuit of power maintains operation of the other motors (2) of the tractor in case one motor fails, resulting in continued operability of the tractor.

In a preferred embodiment of the invention, the drive motors (2) are high voltage brushless DC motors. In an embodiment of the invention, each said drive motor (2) comprises a motor drive electronic unit (21) connected to said separate local HV branch power line (40). The motor drive electronic unit (21) is a HV DC motor drive electronic unit (21). Such brushless motors are provided with an electronic motor drive unit (21) which shapes pulses for driving the motor in a desired direction and at a desired speed.

The electrical conductor logging cable (5) provides high voltage DC directly or indirectly to the common power line (4) in the tool. The surface high voltage DC power supply (50) may provide a voltage between on 300 V to 1800 V, but in an embodiment it provides up to 1200 V to the upper end of the logging cable (5) in order to provide a controlled working voltage of 600 V at the cable head to the common high voltage power line (4) at the tool, including its branch power lines (40). The surface DC power supply (50) must be adjusted for its voltage depending on the actually consumed current in the tractor so as for the voltage at the common high voltage power line (4) to be stable at 600V, but a sudden decrease in the consumed current may cause excursions of up to 1200 V at the electrical conductor logging cable (5). It is not desirable to use AC surface power supply because it would incur a considerable inductive resistance in the AC circuit comprising the very long cable in the well.

The motor drive units are provided with a 30 V input separate from the common high voltage power line (4), for control electronics.

In an embodiment of the invention, the circuit breaker (8) unit comprises control means (82, 86, 88) for monitoring said current (I) on said branch power line (40), and arranged for commanding a power switch (84) on said branch power line (40) to break if said current (I) exceeds said set current level (Imax). In the illustrated embodiment in FIG. 4, the control means (82, 86, 88) comprising a current meter unit (82) for measuring the current (I) on the high voltage branch power line (40), a threshold comparator unit (86) for comparing said measured current (I) and said set current level (Imax), and a control logic unit (88) for steering said power switch (84) on said high voltage branch power line (40). If the threshold comparator (86) finds that said current (I) exceeds said set current level (Imax), the control logic unit (88) commands high voltage power switch (84) to break the current on branch power line (40). Latch means (881) in said control logic unit (88) hold said power switch open if the current on branch power line (40) first has been broken in order to prevent further reconnection of the failed motor (2) and motor drive (21). In an embodiment of the invention, the control logic unit (88) and its latch means (881) may be reset by an operator when the tractor is at the surface so as for enabling testing and reactivation. In an embodiment of the invention it is arranged so as if the power is turned off from the surface completely it will release the latch means (881). This would allow the operator to restart the tool remotely. Should the failure persist the circuit breaker (8) will trip again.

In an embodiment of the invention illustrated in FIG. 4 the current meter unit (82) operates based on measuring a voltage drop over a resistance (823) on said branch power line (40). In an embodiment, the resistance (823) is low-Ohmic in order to have low power consumption and low heat development of the resistance. The current meter unit (82) may comprise a sensor resistance bridge (822) having said sensor resistance (823) connected serially on said local HV power line (40), the differential voltage over said sensor resistance (823) connected to a differential amplifier (824) with an output voltage connected to a first input (861) of said threshold comparator (86), please see FIG. 4. The resistance (823) for being measured for a voltage drop may be constituted by a length of the branch power line (40) itself.

In an embodiment of the invention, the control means (82, 86, 88) is a low-voltage circuit operating on the high voltage side of said high voltage branch power line (40), such as having an internal low voltage level V e.g. 12 V below said high voltage of said HV branch power line (40), please see FIG. 4. The local low-voltage power supply (89) may comprise a control circuit (891) and connected between apparatus ground (AGND) and said local HV DC power line (40) for controlling said low voltage to said local HV DC circuit breaker and keeping it stable if said HV DC power line (40) varies in voltage, in order to provide stable low voltage to the high voltage circuit breaker (8).

In an embodiment of the invention, said HV current meter unit (82) may comprise a magnetic sensor current meter (82*m*) such as Hall effect sensor or a fluxgate magnetometer based device which measures the magnetic field about the conductor and thus indirectly measures the current on branch HV power line (40). Such a magnetic sensor current meter may operate without galvanic contact with the HV power line (40).

In a preferred embodiment of the invention, each motor (2) is connected via a transmission drivetrain (62) to said drive device (6). Each drive device (6) is preferably arranged on a drive arm (61) which may be hydraulically controlled to be forced against or retracted from the wall onto which the wheel drives. The transmission drivetrain may comprise pinion gears and a reduction gear arranged in said arm (61) as sketched in FIG. 2 in order to reduce the motor's high rotational speed of 1500 to 10000 rpm and relatively low torque of 0.5 to 1.5 Nm, geared down 1:50 to 1:150 to a lower desired rotational speed of the wheel and to increase the wheel's torque.

The well tractor of the invention including its electric motors and said circuit breaker (8) is arranged for operating at well temperatures up to 180 degrees C. ambient temperature.

Stated more specifically, the invention may be defined as a downhole petroleum well tractor having a main body (0) connectable to an electrical conductor logging cable (5) from a surface high voltage DC power supply (50), characterized by said main body (0) comprising a common HV DC power line (4) provided with high-voltage DC power supplied from said electrical cable (5); two or more HV DC branch power lines (40) from said common HV DC power line (4), each said HV DC branch power line (40) feeding power to a HV motor drive electronic unit (21) for a drive motor (2); each said drive motors (2) driving one or more drive devices (6) such as wheels (6*w*) drive belts (6*b*) for running on and along a wall in a well for moving said tractor; separate HV DC circuit breaker units (8) on each said HV DC branch power line (40), each said HVDC circuit breaker (8) unit comprising control means (82, 86, 88) arranged for monitoring a current (I) on said HV DC branch power line (40) and controlling a HV DC power switch (84) on said HV DC branch power line (40) to break said current (I) if said current (I) exceeds said set current level (Imax). Each said HV circuit breaker unit (8) is arranged to disconnect its associated motor (2) in case of said associated motor (2) fails, by detecting an increased current above a set current level, in order to prevent shorting said HV power line (4), thus maintaining operation of the other motors (2) of the tractor. The electrical conductor logging cable (5) may be connected directly to said common power line (4).

The invention claimed is:

1. A downhole petroleum well tractor comprising:

a main body connectable to an electrically conducting logging cable from a surface high voltage DC power supply, said main body comprising a common power line providable with DC high voltage energy supplied from said electrical cable, two or more drive motors supplied with power from said common power line each via a branch power line, each said drive motors driving one or more drive devices for running on and along a wall in a well for moving said tractor, separate circuit breaker units for each said drive motors on said branch power line, said circuit breaker unit arranged for monitoring a current to said motor and breaking said current in case said current exceeds a set current level.

2. The well tractor of claim 1, said electrical conductor logging cable providing high voltage DC directly or indirectly to said common power.

3. The well tractor of claim 2, each said drive motor comprising a motor drive electronic unit connected to said separate local HV branch power line.

4. The well tractor of claim 3, wherein said motor drive electronic unit is a HV DC motor drive electronic unit.

5. The well tractor of claim 1, said circuit breaker unit comprising control means for monitoring said current on said branch power line, and arranged for commanding a power switch on said branch power line to break if said current exceeds said set current level ($\mathbf{1}_{max}$).

6. The well tractor of claim 5, said control means comprising a current meter unit, a threshold comparator unit for said measured current and said set current level ($\mathbf{1}_{max}$), and a control logic unit for switching said power switch.

7. The well tractor of claim 6, said current meter unit operating based on measuring a voltage drop over a resistance on said branch power line.

8. The downhole tractor of claim 6, said current meter unit comprising a sensor resistance bridge having said sensor resistance connected serially on said local HV power line, the differential voltage over said sensor resistance connected to a differential amplifier with an output voltage connected to a first input of said threshold comparator.

9. The downhole tractor of claim 6, said control means being a low-voltage circuit operating on the high voltage side of said high voltage branch power line.

10. The well tractor of claim 6, said current meter unit-comprising a magnetic field sensor current meter such as a Hall sensor for measuring a magnetic field around said branch power line.

11. The well tractor of claim 1, said circuit breaker unit comprising latch means in said control logic unit for holding said power switch in the break position if once released.

12. The well tractor of claim 1, said one or more drive devices comprising drive wheels.

13. The well tractor of claim 12, said main body comprising two or more wheel drive sections, each wheel drive section comprising one or more of said motor drive electronic units.

14. The well tractor of claim 1, each motor, connected via a transmission drivetrain to said drive device.

15. The well tractor of claim 1, said drive device arranged on a drive arm.

16. The well tractor of claim 1, said circuit breaker arranged for operating temperatures up to 180 degrees C.

17. The well tractor of claim 1, said surface High voltage power supply providing electric power of a voltage from 300 V to 1800 V.

18. The well tractor of claim 17, said HV power supply arranged for providing stable electric downhole power at a desired high voltage.

19. The well tractor of claim 1, said common DC power line and said branch power line operating on a high voltage between 300 V and 1800 V.

20. The well tractor of claim 1, said two or more drive motors arranged for operating on a voltage of 300 to 1800 V.

21. The well tractor of claim 1, said two or more drive motors being a brushless DC motor.

22. The well tractor of claim 1, each said motor having a power of between 100 and 500 Watt.

23. The well tractor of claim 1, the number of said branch power lines and the number of said two or more drive motors being two or more.

24. The well tractor of claim 1, said set current level on said branch power line being in the range of 0.5 A to 5 A.

25. A method for preventing downhole petroleum well tractor failure, said tractor having a main body connected to an electrically conducting logging cable from a surface high voltage DC power supply, said main body comprising a common power line provided with energy supplied from said electrical cable, two or more drive motors supplied with DC power from said common power line each via a branch power line, each said drive motors driving one or more drive devices running on and along a wall in a well and moving said tractor; the method comprising:

continuously monitoring the DC current on each said branch power line, and in case said current on any one of said branch power line exceeds a set current level, breaking said current separately on said branch power line by means of a circuit breaker unit on said branch power line.

26. The method of claim 25, further comprising monitoring said current on said branch power line using a current meter unit, comparing the value of said measured current with said set current level using a threshold comparator unit, and using a control logic unit for steering said power switch to break said current if said measured current is greater than said set current level ($\mathbf{1}_{max}$).

27. The method of claim 25, wherein said circuit breaker unit using latch means in said control logic unit for holding said power switch in the break position if once released.

28. A downhole tractor drive motor, arranged for driving one or more drive devices for running on and along a wall in a well for moving a well tractor, comprising a main body mechanically connectable to an electrically conducting logging cable from a surface high voltage DC power supply, said main body having a common DC power line provided with voltage supplied from said electrical cable and having two or more branch DC power lines, a circuit breaker unit connecting said branch DC power line to one said associated drive motor, said circuit breaker unit arranged for monitoring a current to said motor and breaking said current in case said current exceeds a set current level.

29. The downhole tractor drive motor of claim 28, wherein the circuit breaker unit is further arranged for monitoring said current on said branch power line, and arranged for commanding a power switch on said branch power line to break if said current exceeds said set current level.

30. The downhole tractor drive motor of claim 28, said control means comprising a current meter unit, a threshold comparator unit for said measured current and said set current level, and a control logic unit for steering said power switch.

31. The downhole tractor drive motor of claim 30, said current meter unit operating based on measuring a voltage drop over a resistance on said branch power line.

32. The downhole tractor drive motor of claim 30, said current meter unit comprising a sensor resistance bridge having said sensor resistance connected serially on said local HV power line, the differential voltage over said sensor resistance connected to a differential amplifier with an output voltage connected to a first input of said threshold comparator.

33. The downhole tractor drive motor of claim 30, said control means being a low-voltage circuit operating on the high voltage side of said high voltage branch power line.

34. The downhole tractor drive motor of claim 30, said current meter unit comprising a magnetic field sensor current meter such as a Hall sensor for measuring a magnetic field around said branch power line, wherein the current meter is further arranged for determining said current-on said branch power line based on said magnetic field.

35. The downhole tractor drive motor of claim 28, said circuit breaker unit comprising latch means in said control logic unit for holding said power switch in the break position once the current in branch power line drops below the set current level since the motor and motor drive are now disconnected.

* * * * *